US007293328B2

(12) United States Patent
Endres

(10) Patent No.: US 7,293,328 B2
(45) Date of Patent: Nov. 13, 2007

(54) DEVICE FOR CLOSING A DOOR

(76) Inventor: Volker Endres, Elchstrasse 25, 97941 Tauberbischofsheim (DE)

( * ) Notice: Subject to any disclaimer, the term of this patent is extended or adjusted under 35 U.S.C. 154(b) by 0 days.

(21) Appl. No.: 11/237,195

(22) Filed: Sep. 27, 2005

(65) Prior Publication Data

US 2006/0021190 A1 Feb. 2, 2006

Related U.S. Application Data

(63) Continuation-in-part of application No. PCT/DE2004/00598, filed on Mar. 23, 2004.

(30) Foreign Application Priority Data

Mar. 27, 2003 (DE) ..... 103 14 098

(51) Int. Cl.
*E05F 5/06* (2006.01)

(52) U.S. Cl. ..... 16/85; 16/72

(58) Field of Classification Search ..... 16/82, 16/85, 86 B, 86 A, 86 R, 274, 72, 374–376; 49/386; 292/297, 298
See application file for complete search history.

(56) References Cited

U.S. PATENT DOCUMENTS

| | | | | |
|---|---|---|---|---|
| 29,162 | A * | 7/1860 | McLennan | 172/753 |
| 277,153 | A * | 5/1883 | Markley | 383/124 |
| 2,394,878 | A * | 2/1946 | Slopa | 292/79 |
| 2,515,875 | A * | 7/1950 | Jones | 16/70 |
| 2,651,074 | A * | 9/1953 | Slopa et al. | 16/80 |
| 2,706,828 | A | 4/1955 | Spears | |
| 3,389,501 | A * | 6/1968 | Harmon | 49/386 |
| 3,411,241 | A * | 11/1968 | Harmon | 49/386 |
| 3,425,386 | A * | 2/1969 | Campbell | 116/87 |
| 3,751,759 | A * | 8/1973 | Duncan | 16/50 |
| 4,196,924 | A * | 4/1980 | Iseki | 292/79 |
| 4,819,295 | A * | 4/1989 | Kaftan | 16/72 |
| 5,539,954 | A * | 7/1996 | Ambar | 16/85 |
| 5,649,339 | A * | 7/1997 | Reed | 16/72 |
| 6,477,736 | B1 * | 11/2002 | Abernathy | 16/72 |
| 6,715,182 | B2 * | 4/2004 | Cheng | 16/280 |
| 6,728,992 | B1 * | 5/2004 | Rogers | 16/76 |

FOREIGN PATENT DOCUMENTS

| | | | |
|---|---|---|---|
| DE | 249 837 | | 8/1911 |
| DE | 2718605 | A * | 11/1977 |
| DE | 83 09 378 | U1 | 12/1983 |
| DE | 37 00 467 | A1 | 7/1988 |
| DE | 100 34 071 | A1 | 3/2001 |
| DE | 101 41 796 | A1 | 3/2003 |
| GB | N21464 | A | 2/1914 |
| JP | 10196216 | A * | 7/1998 |
| JP | 2003082924 | A * | 3/2003 |
| SU | 1597111 | A * | 9/1990 |

OTHER PUBLICATIONS

International Search Report re PCT Application No. PCT/DE2004/000598, dated Sep. 10, 2004.

* cited by examiner

*Primary Examiner*—Chuck Y. Mah
(74) *Attorney, Agent, or Firm*—Graybeal Jackson Haley LLP

(57) ABSTRACT

A device for closing a door, including a spring element, an attachment element for fixing the device to a door, and an actuation element. The actuation element and the attachment element are linked at opposite ends of the spring element in such a way that, when the door is opened, differential rotation of the actuation element and the attachment element cause the spring element to be stretched and the energy stored in the spring element causes the door to close automatically. The actuation element is embodied as a support element that can be placed against the door frame or the adjacent wall regions in a supporting manner, and the attachment element can be removably mounted on an edge of the door without the use of fasteners or adhesive.

16 Claims, 4 Drawing Sheets

A – A

DEVICE FOR CLOSING A DOOR

CROSS-REFERENCE TO RELATED APPLICATION

This is a continuation-in-part application that claims benefit, under 35 USC §120, of co-pending International Application PCT/DE2004/000598, filed on 23 Mar. 2004, designating the United States, which claims foreign priority under 35 USC §119(a) to German Patent Application No. DE10314098.0, filed 27 Mar. 2003, which applications are incorporated herein by reference.

BACKGROUND OF INVENTION

Devices of the type to which the invention is directed are used for automatic closing of doors, gates, flaps or the like. When the door is opened, a spring element is tensioned. As soon as the opened door is released, the energy stored in the tensioned spring element is released and the spring element brings the door into the closed position, or at least into a position in which the door is ajar, as a result of its elastic restoring force.

A plurality of generic devices are known from the prior art. Closing devices in which the entire device is arranged in a separate housing that is attached to the wall next to or above the door are used in the area of house doors and heavy gates. The door is connected to the device by means of a hinged arm mechanism attached to the door. High closing forces can certainly be stored and released with this known device; however, as a result of the size dependent on the design, its use for room doors or the like is generally not possible or at least is not desired for aesthetic reasons.

Closing device integrated directly in a door hinge are further known. The closing forces are certainly small but these are generally sufficient to bring an opened door at least into an ajar position. However, a disadvantage with these known closing devices is that they must be planned and built in during the initial assembly of the respective door and the door frame; it is generally not possible to retrofit the door with such a closing device.

Starting from this prior art, there is a need for a device to close a door, which can be mounted and dismounted subsequently even when the door is installed, without the need to make modifications to the door or the door frame.

DESCRIPTION OF THE INVENTION

A device according to the invention comprises in an initially known fashion a spring element, an attachment element for attaching said device to a door and an actuation element, wherein said actuation element and said attachment element can be coupled to said spring element in such a way that the spring element is tensioned during opening of said door and that the energy stored in said spring element causes a bias to said door. According to the invention, said actuation element is formed as a support element that can be brought into supporting abutment with a door frame or architrave or adjacent wall portions, and said attachment element can be removably engaged without fasteners to an edge or side portions of said door.

As a consequence of this arrangement, no attachment of the support element to the door frame is necessary and the attachment to the door is effected by removable engagement with both sides of the door, or the door edge. Any arbitrary door can thereby be subsequently retrofitted in a simple fashion with a closing device that can additionally be mounted and dismounted without any modification to the door and door frame and usually without tools. In addition to retrofitting applications, it is thus also possible, when moving from one residence to another, for example, to dismount the closing device and use it on another door.

According to one embodiment of the invention, the attachment element has an attachment section and a housing for at least partial receipt of the spring element. This means that the function of the spring element and the attachment of the device according to the invention are functionally and spatially separated.

The shape of the attachment rail and thus its function of securely attaching the device on the door to be fitted therewith depends substantially on the geometry of the door edge.

According to a preferred exemplary embodiment, the attachment rail is formed as substantially U-shaped in cross-section at least in sections and embraces the door edge. The term "substantially U-shaped at least in sections" should in this case comprise both a complete U-profile and also a profile whose one leg extends over the entire length of the attachment rail whereas the opposing "leg" is merely formed by one or a plurality of hook-like attachments. An attachment rail comprising one or a plurality of U-shaped clips which are interconnected, should also come under this term. It is merely important that the attachment rail embraces the door edge on both sides, at least in sections. At the same time, the width of the U-profile can be predefined so that different attachment rails are used for different door frame profiles. Alternatively thereto, however, the U-profile can be variable in its width, i.e., adjustable.

Since in particular newly installed doors generally have a peripheral rectangular edge, especially in the form of a peripherally projecting spring or a projection, a U-shaped attachment rail is sufficient for a plurality of applications. According to a further exemplary embodiment however, the inner profile of the attachment rail is formed substantially complementary in shape to the outer profile of the door edge. Thus, an adaptation to different door edge geometries can be made in a simple fashion by selecting the corresponding attachment rail.

In order to ensure a secure and defined transmission of force from the door to the housing via the attachment rail during opening and closing the door, according to one exemplary embodiment, the attachment rail is disposed substantially rigidly on the housing. In this case, the rigid arrangement can be effected by a non-detachable fixing, for example, welding or gluing or, however, also by a detachable fixing in certain circumstances. A detachable fixing is especially advantageous when the attachment rail is to be exchanged to adapt to different door edge geometries.

According to an especially preferred embodiment, however, the attachment rail is formed integrally on the housing, for example, is cast thereon or injection-molding thereon. Simple and inexpensive manufacture is thereby possible.

The housing on which the attachment rail is disposed is used substantially for at least partial receipt of the spring element. According to one embodiment, this housing is formed for this purpose as substantially tube- or cup-shaped. In this case, "tube- or cup-shaped" in no way comprises only cylindrical shapes; rather the housing can also have a prismatic, triangular, square, polygonal or other cross-sectional shape.

The attachment rail can be disposed in a fundamentally arbitrary fashion in the longitudinal direction of the housing. Preferably however, the attachment rail is disposed substantially at right angles to the longitudinal axis of the housing so that the attachment rail can be gently clipped onto the upper horizontal transverse edge of the door in the corner area whereas the housing extends substantially at right angles thereto and substantially parallel to the vertical edge of the door. A particularly simple and reliable attachment of the device according to the invention to the door is obtained in this case.

The shape of the actuation element is fundamentally arbitrary so long as reliable transmission of force from the spring element to the door frame or the architrave is possible. According to a particularly preferred exemplary embodiment of the invention however, the actuation element is formed as substantially U- or L-shaped shaped and engages with one of its legs in the especially cup- or tube-shaped housing in such a way that the actuation element is pivotable about this leg and the longitudinal axis of said housing. Especially if the pivot axis of the actuation element, the longitudinal axis of the housing and the pivot axis of the door are in alignment, the actuation element undergoes an almost pure advantageous moment loading during opening and closing the door.

The free leg of the actuation element is preferably formed as an abutment element on the door frame or architrave. At the same time, the abutment element can be provided with a coating, a covering or the like, in particular, of an elastomer, to protect the door frame.

The type and shape of the spring element is fundamentally arbitrary as long as the force or energy applied during opening of the door can be stored elastically and released again. Thus, the spring element can be formed as a radial spring element. "Radial spring element" in the sense of the present invention means that the rotation of the actuation element, especially in the housing, brings about a compression or tensioning of the spring element in the circumferential direction relative to the axis of rotation of the actuation element. Thus, for example, an elastomer buffer can be used as a radial spring element, which is pressed by a radially projecting attachment on the actuation element against a counter-bearing disposed in the housing, or formed by a section of the housing inner wall. It is also feasible that the actuation element is vulcanised into the housing by means of a highly loadable elastomer, wherein the elastomer undergoes shear-loading when the actuation element is twisted.

According to a particularly preferred embodiment of the invention, however, the spring element is formed as a coil spring. In this case, the coil spring is preferably disposed in the housing such that the first end of the coil spring can be brought into supporting abutment on the housing on opening the door. This supporting abutment can advantageously be achieved by the coil spring having a radially outwardly extending attachment at its first end, which can be brought into engagement in at least one slot-like recess in the front edge of the cup- or tube-shaped housing. The coil spring is thereby reliably secured against unintentional twisting in the housing.

When a coil spring is used, the elastic storage of the force or energy expended during the opening is only possible in one direction of rotation. This means in particular that in the arrangement described heretofore, different devices, but at least different coil springs, must be used for left- and right-hand hinged doors. According to a quite especially preferred exemplary embodiment of the invention, however, respectively at least one slot-like recess is provided in the axially opposing front edges of the cup- or tube-shaped housing. As a result, the coil spring can be inserted in the housing both from above and also from below, turned through 180 degrees, and can be locked rotationally fixedly therein, supported in the respective slot-like recess, whereby the direction of rotation of the device can be simply converted from left- to right-hand hinging.

According to a further exemplary embodiment, the second end of the coil spring is attached to the actuation element such that, during opening and closing of the door, a reliable transmission of force and therefore a tensioning twist of the spring element is ensured between housing and door frame or architrave.

According to a preferred exemplary embodiment, this attachment is effected by the L- or U-shaped actuation element engaging with its first leg in the cylindrical interior of the coil spring and the coil spring having an axially projecting attachment at its second end, which can be inserted into at least one recess disposed in the free leg of the L- or U-shaped actuation element. In this arrangement, the conversion from left- to right-hand hinging and conversely is made by changing over the coil spring as described heretofore and simultaneously changing over the actuation element, turned through 180 degrees, from above or from below in the interior of the coil spring.

In order to be able to adjust the tension or pre-tension of the spring element and therefore the closing force, according to a further exemplary embodiment, the free leg is formed as plate-shaped, at least in certain areas, wherein in this plate-shaped area at least two recesses are disposed at a distance apart in the circumferential direction on a circular arc or section of a circular arc, which runs substantially concentrically to the longitudinal axis of the first leg. By means of this arrangement, the axially projecting attachment of the coil spring can be inserted into one of the recesses as desired whereby the pre-tension of the coil spring is pre-selected.

Alternatively to the embodiments with a radial spring element described hereinbefore, the spring element can fundamentally also be formed as an axial spring element. For example, this can be effected in a fundamentally known fashion by providing the leg of the actuation element which dips into the housing, with a motion thread which passes through a spindle nut mounted axially movably but rotationally fixedly in the housing. During rotation of the actuation element relative to the housing on opening the door, the spindle nut moves in the axial direction, wherein a spring element disposed in the housing, for example a coil spring or an elastomer buffer, can be pressed by the spindle nut.

DETAILED DESCRIPTION OF THE DRAWINGS

The invention is explained in detail hereinafter merely with reference to drawings which show exemplary embodiments. In the figures.

DETAILED DESCRIPTION OF THE EMBODIMENTS

Figure 1:
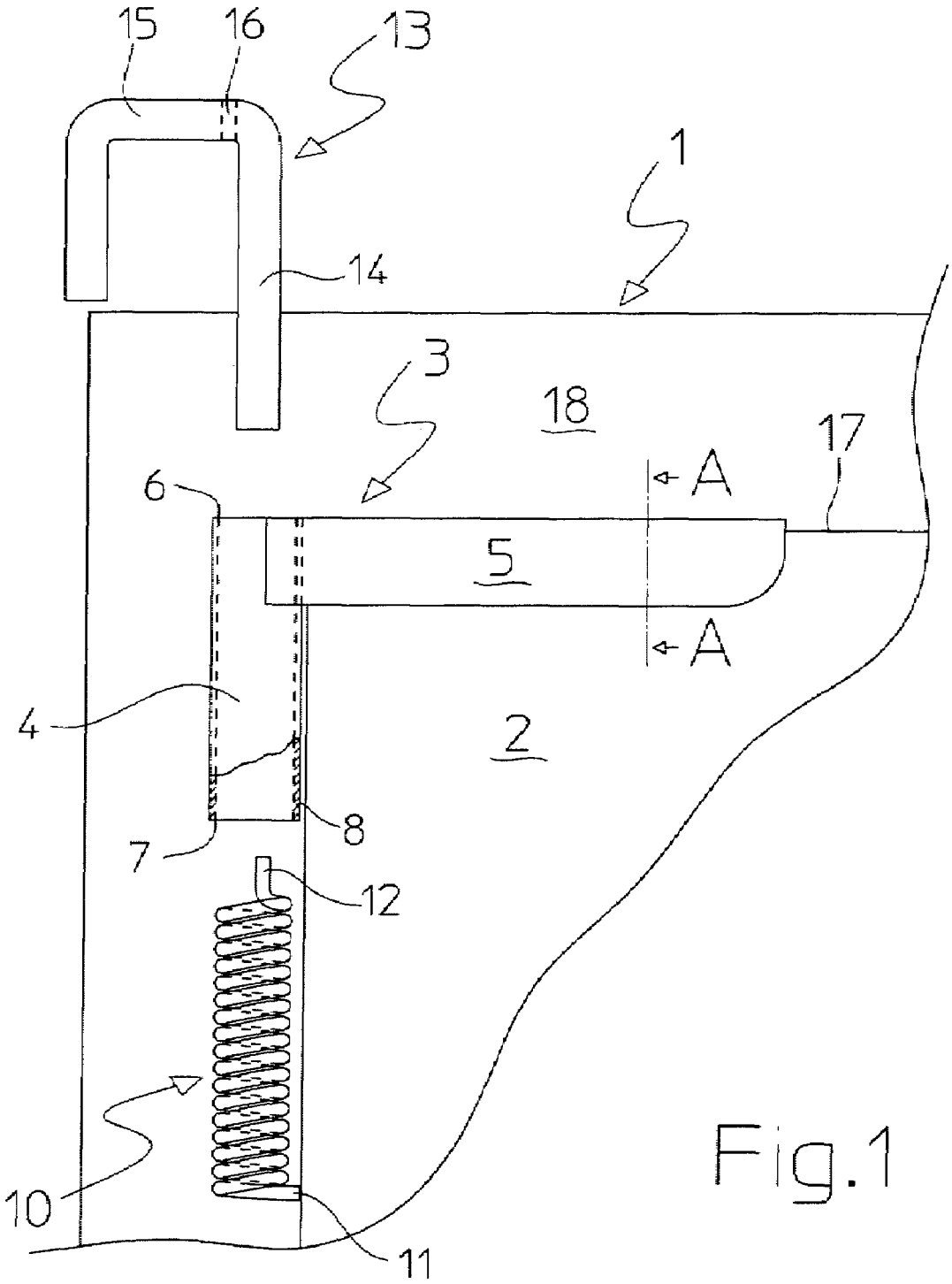
FIG. 1 is a schematic view of an exemplary embodiment of a device according to the invention in a partly broken exploded view placed on a door with a left-hand hinge.
Figure 2:
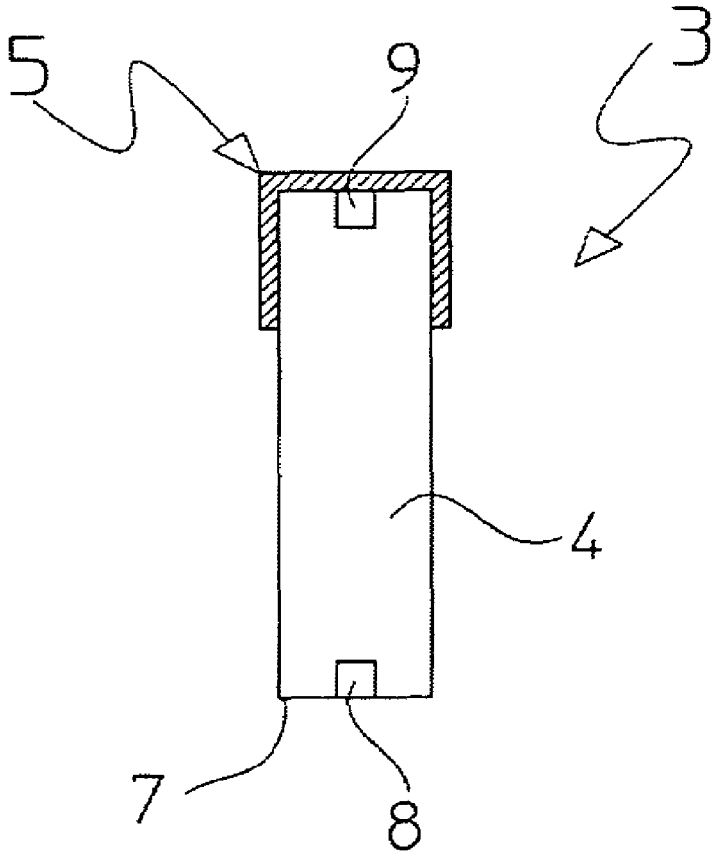
FIG. 2 shows the section A-A through the attachment rail from FIG. 1.

FIG. 1 shows an exemplary embodiment of a device 1 according to the invention for closing a door 2. The device 1 has an attachment element 3 which substantially consists of a housing 4 and an attachment rail 5. The attachment rail 5 has a substantially U-shaped cross-section (see FIG. 2) and is welded on the housing 4 at its first end.

The housing 4 is constructed as substantially cylindrically tube-shaped and is open at both faces 6, 7. The walls of the housing 4 are each provided with a slot-like recess 8 and 9 in the area of its two faces 6 and 7. A spring element in the form of a coil spring 10, whose outside diameter is at least slightly smaller than the inside diameter of the housing 4 can be inserted into the housing from below in the view according to FIG. 1. The coil spring 10 has a substantially radially outwardly extending attachment 11 at its first end which enters into engagement in the slot-like recess 8 when the coil spring 10 is inserted. The coil spring 10 is thereby mounted rotationally fixedly in the housing 4.

At its second end axially opposed to the first end, the coil spring 10 further has an axially projecting attachment 12 which is disposed eccentrically to the central axis in the edge zone of the coil spring. The coil spring 10 has a length such that when the coil spring 10 is completely inserted into the housing 4, the attachment 11 simultaneously engages in the recess 8 and the attachment 12 projects at least slightly from the face 6 of the housing 4.

An actuation element 13 in the form a substantially L-shaped clip has a first leg 14 and a second free leg 15 running substantially at right angles thereto. The free leg 15 is bent at its free end. In this case, the actuation element 13 consists of a round material which has an outside diameter at least slightly smaller than the outside diameter of the coil spring 10. The actuation element 13 can be inserted into the coil spring 10 with its leg 14.

In the area of its free leg 15, more precisely in the transition zone between the first leg 14 and the free leg 15, the actuation element 13 is provided with a through recess 16 having a diameter which is at least slightly larger than the diameter of the attachment 12 of the coil spring 10. When the actuation element 13 is inserted into the coil spring, the attachment 12 of the coil spring 10 enters into engagement in the recess 16.

The exemplary embodiment of a device according to the invention from FIG. 1 is clipped onto the upper edge 17 of the left-hand hinged door 2 with the attachment rail 5, where the width of the edge profile of the door 2 substantially corresponds to the inner width "b" (see FIG. 2) of the U-shaped attachment rail 5. A fixed arrangement of the attachment rail 5 on the door 2 which is substantially free from play in the horizontal direction is thus obtained. When the door 2 is almost closed, the clip-shaped actuation element 13 inserted in the coil spring 10 is brought into a position by twisting in which the free end 15 can be brought into abutment on the door frame 18 wherein in this case the coil spring 10 is advantageously at least slightly pre-stressed. If the door 2 is now opened, as a result of the relative pivoting movement between the actuation element 13 and the housing 4 and the coupling of the coil spring 10 on the one hand to the actuation element 13 and on the other hand to the housing 4, the coil spring 10 is tensioned, the energy expended on opening the door being stored elastically. If the opened door is now released, the tension of the coil spring 10 is removed, wherein the stored energy is released and the door is thereby closed.

Figure 3:
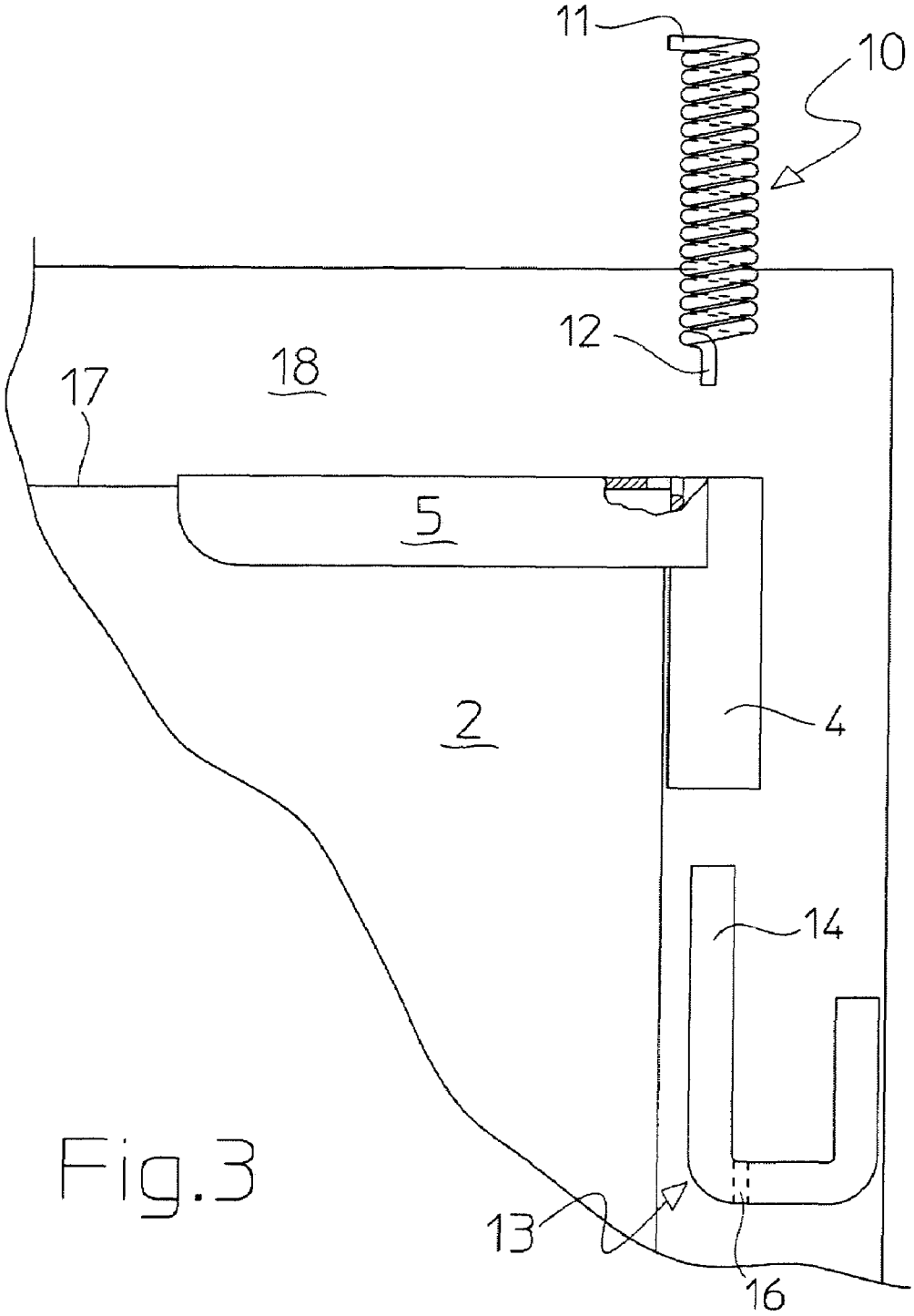
FIG. 3 shows the exemplary embodiment from FIG. 1 in a view corresponding to FIG. 1 placed on a door with a right-hand hinge.

The exemplary embodiment shown in FIG. 3 has the same structure as the exemplary embodiment from FIG. 1 and in particular, the same elements. Merely by changing over the coil spring 10 and the attachment element 13, the device 1 according to the invention can be converted for use on a door with a right-hand hinge without any constructive modifications and without using a tool.

Figure 4:
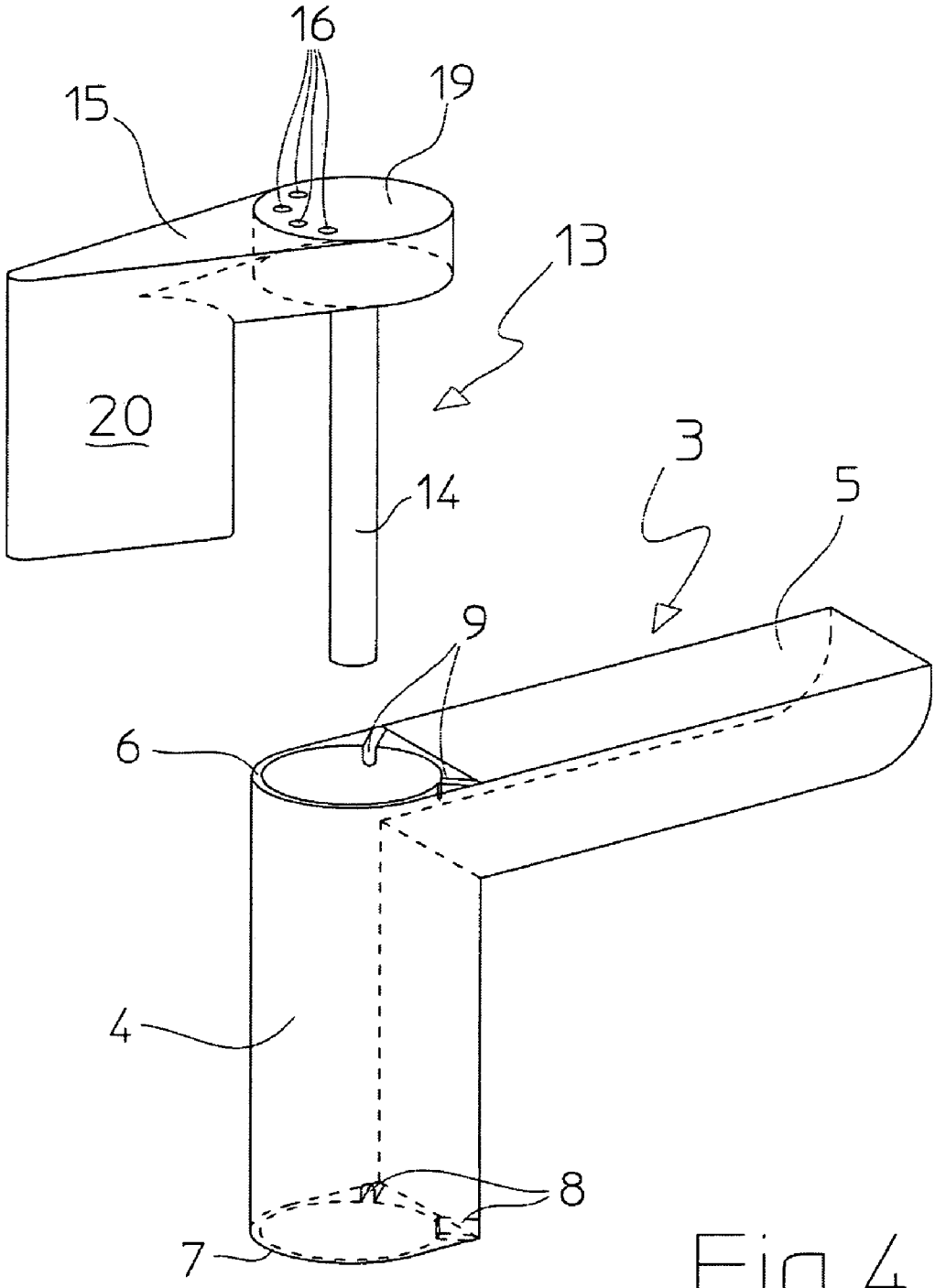
FIG. 4 shows a schematic perspective view of a further exemplary embodiment.

FIG. 4 shows a further exemplary embodiment of a device according to the invention where the coil spring which corresponds to the coil springs shown in FIGS. 1 and 3 is not shown to simplify the diagram. The device comprises an attachment element 3' with an attachment rail 5' and a housing 4' for receiving the coil spring not shown. The attachment element is manufactured in one piece as a plastic injection moulding. Respectively two slot-like recesses 8' or 9' are disposed in the area of the faces 6' and 7' for fixing receipt of the radial attachment of the coil spring. The turning position of the coil spring and therefore the pre-stress can be pre-set through the choice of the respective recess 8' or 9'.

The device according to FIG. 4 further has a substantially L-shaped actuation element 13' with a first leg 14' and a free leg 15'. The first leg 14' is inserted in the housing 4' through the coil spring disposed in the housing 4' and substantially serves as an axis of rotation for the actuation element 13'. The free leg 15' is constructed as substantially wedge-shaped with a plate-shaped area 19 and at its end pointing away from the first leg 14' has a flat clip-shaped abutment element 20 with which the actuation element 13' is supported on the door frame during opening and closing of the door. In the plate-shaped area 19 a plurality of axially continuous recesses 16 are disposed on a circular arc whose centre point lies on the longitudinal axis of the first leg 14'. As a result, when the actuation element tilts as prescribed, the recesses 16'move on a circular or circular-arc-shaped path around the longitudinal axis. By selecting the recesses 16' in which the axial attachment of the coil spring will be inserted when the device according to the invention is mounted on a door edge, the pre-stress of the coil spring and, therefore, the closing force can be pre-set in a simple fashion. The actuation element 13' is manufactured in one piece as a plastic injection moulding.

What is claimed is:

1. A device for closing a door, the door having an upper perimeter, a hinge side surface and a non-hinge side surface, the device comprising:

a spring element;

an attachment element for attaching said device to a door, the attachment element comprising an attachment rail having a door upper perimeter contacting portion to support the attachment element and having a door hinge side surface contacting portion, and further comprising a housing, which defines a longitudinal axis, for at least partially receiving the spring element; and an actuation element coupled to the spring element, for contacting a door frame or a wall portion adjacent to the door frame, whereby said actuation element and said attachment element are rotationally coupled to impart tension in the spring element during opening of said door and the energy stored in said spring element establishes a door closing bias, characterized in that said actuation element can be brought into abutment with the door frame or the adjacent wall portion during opening of the door, and said attachment element is operably engagable with the upper perimeter and hinge side surface of the door without the use of fasteners or adhesives.

2. The device according to claim 1, characterized in that said attachment rail has a substantially U-shaped in cross-section.

3. The device according to claim 1, characterized in that said attachment element is disposed substantially rigidly on said housing.

4. The device according to claim 1, characterized in that said attachment element is formed integrally on said housing.

5. The device according to claim 1, characterized in that said housing is formed as substantially tube- or cup-shaped.

6. The device according to claim 1, characterized in that said attachment rail is disposed substantially at right angles to the longitudinal axis of said housing.

7. The device according to claim 1, characterized in that said actuation element comprises a first leg and a free leg, and is formed as substantially U- or L-shaped wherein the first leg is rotationally coupled to the housing and is pivotable about a longitudinal axis of said housing.

8. The device according to claim 7, characterized in that the free leg is formed as an abutment element.

9. The device according to claim 8, characterized in that said abutment element is provided with a resilient coating.

10. The device according to claim 1, characterized in that said spring element is formed as one of a radial spring, a coil spring, or an axial spring.

11. The device according to claim 10, characterized in that said spring is a coil spring, and a first end of said coil spring can be brought into supporting abutment on the housing upon opening the door.

12. The device according to claim 11, characterized in that said coil spring has a radially outwardly extending attachment at its first end, which can be brought into engagement in at least one recess defined by the housing for receiving the spring, where the housing comprises a front edge and is one of cup- or tube-shaped.

13. The device according to claim 12, characterized in that respectively at least one slot-like recess is provided in axially opposing front edges of said cup- or tube-shaped housing.

14. The device according to claim 12, characterized in that a second end of said coil spring is attachable to said actuation element.

15. The device according to any one of the previous claims, characterized in that an inner cross section profile of said attachment rail is formed substantially complementary in shape to an outer cross section profile of said door upper perimeter.

16. A device for closing a door, the door having an upper perimeter, a hinge side surface and a non-hinge side surface, the device comprising:

a coil spring element having a cylindrical interior, a first end and a second end;

an attachment element having a housing, which defines a longitudinal axis, for receiving at least a portion the spring element, said attachment element adapted for attaching said device to the door; and a substantially U- or L-shaped actuation element having first leg and a free leg defining a door attachment location wherein the first leg is rotationally coupled to the housing about the housing longitudinal axis, wherein said first leg is at least partially insertable in the cylindrical interior of the coil spring, wherein said coil spring second end is engagable with a recess in the free leg of said L- or U-shaped actuation element, wherein said free leg is formed as plate-shaped at least in certain areas, and wherein, in said plate-shaped area, at least two recesses are disposed at a distance apart in the circumferential direction on a circular arc, or section of a circular arc, which runs substantially concentrically to a longitudinal axis of said first leg, whereby said actuation element and said attachment element are rotationally coupled to impart tension in the spring element during opening of said door and the energy stored in said spring element establishes a door closing bias, characterized in that said actuation element can be brought into abutment with a door frame or wall portions adjacent to the door frame during opening of the door, and said attachment element is operatively engagable with at least an upper perimeter of the door without the use of fasteners or adhesives.

* * * * *